US009125460B2

(12) United States Patent
Olsen et al.

(10) Patent No.: US 9,125,460 B2
(45) Date of Patent: Sep. 8, 2015

(54) WRISTWORN DEVICE WITH A RELEASABLE LOCKING ARRANGEMENT

(71) Applicant: Timex Group USA, Inc., Middlebury, CT (US)

(72) Inventors: Fred Olsen, Oslo (NO); Bernhard Kaiser, Pforzheim (DE); Gerhard Stotz, Eisingen (DE)

(73) Assignee: Timex Group USA, Inc., Middlebury, CT (US)

( * ) Notice: Subject to any disclaimer, the term of this patent is extended or adjusted under 35 U.S.C. 154(b) by 197 days.

(21) Appl. No.: 13/964,383

(22) Filed: Aug. 12, 2013

(65) Prior Publication Data

US 2015/0040611 A1 Feb. 12, 2015

(51) Int. Cl.

| | |
|---|---|
| ***A44C 5/20*** | (2006.01) |
| ***A44B 11/25*** | (2006.01) |
| ***A44C 5/00*** | (2006.01) |
| *A44B 11/26* | (2006.01) |

(52) U.S. Cl.

CPC ..... *A44C 5/2066* (2013.01); *A44C 5/0053* (2013.01); *A44B 11/263* (2013.01); *A44B 11/266* (2013.01); *Y10T 24/213* (2015.01); *Y10T 24/45743* (2015.01); *Y10T 24/4782* (2015.01)

(58) Field of Classification Search

CPC ..... A44B 11/20; A44B 11/22; A44B 11/223; A44B 11/226; A44B 11/2534; A44B 11/2584; A44B 11/26; A44B 11/263; A44B 11/266; A44B 11/2511; A44C 5/2052; A44C 5/2071; Y10T 24/4782; Y10T 24/213; Y10T 24/45743; Y10T 24/45654

USPC ..... 224/164, 176; 368/282

See application file for complete search history.

(56) References Cited

U.S. PATENT DOCUMENTS

| | | | | |
|---|---|---|---|---|
| 941,096 | A | | 11/1909 | Pugatsky et al. |
| 2,536,146 | A | | 1/1951 | Wiese |
| 3,765,064 | A | | 10/1973 | Hoober et al. |
| 4,234,115 | A | * | 11/1980 | Williams ..... 224/168 |
| 4,847,818 | A | | 7/1989 | Olsen |
| 4,941,236 | A | | 7/1990 | Sherman et al. |
| 5,218,577 | A | | 6/1993 | Seager |
| 5,228,012 | A | | 7/1993 | Seager |
| 5,235,560 | A | | 8/1993 | Seager |
| 5,235,567 | A | | 8/1993 | Goodwin |
| 5,251,189 | A | | 10/1993 | Thorp |
| 5,260,915 | A | | 11/1993 | Houlihan |
| 5,522,529 | A | | 6/1996 | Yurman et al. |
| 6,014,793 | A | | 1/2000 | Howald |
| 6,145,171 | A | | 11/2000 | Hoshino |
| 6,484,376 | B1 | | 11/2002 | Khatchadourian et al. |
| 6,622,349 | B2 | | 9/2003 | Wong |
| 7,207,091 | B2 | | 4/2007 | Dunaye |

(Continued)

*Primary Examiner* — Jack W Lavinder

(74) *Attorney, Agent, or Firm* — Carmody Torrance Sandak & Hennessey LLP

(57) ABSTRACT

A wristworn device having a releasable coupling mechanism for releasably coupling a first strap section and a second strap section about a user's wrist. The wristworn device includes an elongated member that is positioned within a channel of one of the strap sections and which has an actuation section that extends from the channel. A directional force upon the actuation section of the elongated member causes a slidable locking plate in the releasable coupling mechanism to move in a direction and disengage from a locking member, whereby separation of the sections of the releasable coupling mechanism is facilitated upon the disengagement of the slidable locking plate from the locking member.

14 Claims, 11 Drawing Sheets

(56) References Cited

U.S. PATENT DOCUMENTS

| | | | | |
|---|---|---|---|---|
| 7,363,687 | B2 | 4/2008 | Kraus et al. | |
| 7,397,437 | B2 | 7/2008 | Hasumi | |
| 7,480,967 | B2 | 1/2009 | Kojoori et al. | |
| 7,568,263 | B2 | 8/2009 | Kim et al. | |
| 8,029,185 | B2 | 10/2011 | Faucher et al. | |
| 8,250,797 | B2 | 8/2012 | Padgett et al. | |
| 2006/0096070 | A1 | 5/2006 | Ishida | |
| 2007/0039141 | A1 | 2/2007 | Rairden | |
| 2009/0151131 | A1 * | 6/2009 | Schultz | 24/163 R |
| 2011/0179604 | A1 | 7/2011 | Desser | |
| 2013/0094142 | A1 | 4/2013 | Ligtenbert et al. | |

* cited by examiner

WRISTWORN DEVICE WITH A RELEASABLE LOCKING ARRANGEMENT

BACKGROUND OF THE INVENTION

The present invention is directed generally to releasable locking arrangements for wristworn devices, and in particular, to an improved releasable locking arrangement for a wristworn device that preferably includes phone and/or music (e.g. MP3) functionality. That is, the present invention provides for constructions and methodologies that facilitate and expedite the coupling and decoupling of the wristworn device to a wrist. In a preferred embodiment, the wristworn device has timekeeping functionality (e.g. the device can be in the form of a wristwatch) and also preferably functions as a phone or music (e.g. MP3) player, thereby requiring efficient and rapid removal of the wristworn device from the wrist for easy manipulation and placement proximate a person's ear, but as will be understood from the disclosure herein, the invention is not so limiting.

Wristworn devices that also function as a phone are known in the art. For example, U.S. Pat. Nos. 4,847,818; 5,218,577; 5,228,012; 5,235,560; 5,251,189 and 5,260,915, all owned by the present assignee, all recognize the advantages of providing phone functionality into a wristworn device. Such examples all have mechanisms for removing the device from one's wrist.

However, most wristworn devices in the form of a wristwatch that have phone functionality are maintained on the wrist with a buckle or clasp, which is typically positioned on the side of the wrist opposite the watch head, and which typically requires removal with the action and manipulation of only one hand, which can be less than quick or easy, especially for those with less than optimal dexterity. It is also less than desirable to require a user to use the phone function while the device remains on the wrist without an option for quick removal and placing it up to one's ear, etc.

Wristworn device manufacturers (such as timepiece manufacturers) and their customers also desire to maintain the aesthetics of such devices, such as by maintaining the inclusion of a buckle or clasp and positioning it opposite the watch head. Thus, it is also desirable to minimally disrupt the aesthetics of the wristworn device itself.

However, being able to more quickly and more easily remove the wristworn device from one's wrist is seen to be an important aspect of achieving increased and/or widespread usage and adoption of such a wristworn (e.g. phone) device.

It is thus believed that further advances to the state of the art are both desirable and achievable. In particular, it is desirable to provide users with the ability to more quickly, efficiently and easily decouple a wristworn device from a wrist in order for such a device to function as a convenient phone receiver (or speaker as the case may be) and/or transmitter, e.g. being able to use it against one's mouth and/or ear. Accordingly, such constructions and methodologies for such improved releasable locking arrangements in accordance with the present invention are set forth herein.

SUMMARY AND OBJECTIVES OF THE INVENTION

It is thus an objective of the present invention to overcome the perceived deficiencies in the prior art.

For example, it is an objective of the present invention to provide a wristworn device that facilitates the incorporation of phone or music functionality.

It is another objective of the present invention to provide a wristworn device that facilitates and expedites the coupling and decoupling of the wristworn device to a wrist.

It is yet another objective of the present invention to provide a wristworn device that provides efficient and rapid removal of the wristworn device from the wrist for easy manipulation and placement near a person's ear.

It is still another objective of the present invention to provide a wristworn device that achieves the aforementioned objectives while still maintaining a high aesthetic quality, such as including but not limited to incorporating a buckle or clasp on the side of the device opposite the module e.g. watch head.

Still another objective of the present invention is to provide a wristworn device that facilitates removal with only one hand.

It is still another objective of the present invention to provide a wristworn device that facilitates increased usage and adoption of such a wristworn (phone) device.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

Therefore, and generally speaking, in accordance with a first preferred embodiment, the invention is directed to a wristworn device comprising a wristworn device module; a first strap section having a first end and a second end, wherein the first end is coupled to a first end of the wristworn device module; a second strap section having a first end and a second end, wherein the first end is coupled to a second end of the wristworn device module, and wherein the second strap section further comprises a channel therein; a releasable coupling mechanism for releasably coupling the first strap section and the second strap section; wherein the second end of the first strap section is coupled to a first end of the releasable coupling mechanism and the second end of the second strap section is coupled to a second end of the releasable coupling mechanism; wherein the releasable coupling mechanism comprises an inserting section comprising a locking member, and a receiving section comprising a slidable locking plate that releasably engages the locking member to releasably couple the inserting section of the releasable coupling mechanism and the receiving section of the releasable coupling mechanism; an elongated member having a portion thereof positioned within the channel of the second strap section, wherein the elongated member comprises (i) a first end coupled to the slideable locking plate and (ii) an actuation section that extends from the channel of the second strap section; wherein a directional force upon the actuation section of the elongated member causes the slidable locking plate to move in a direction so as to disengage from the locking member; whereby separation of the inserting section of the releasable coupling mechanism from the receiving section of the releasable coupling mechanism is facilitated upon the disengagement of the slidable locking plate from the locking member.

In accordance with another preferred embodiment of the present invention, a method of removing a wristworn device from a wrist of a user is provided. The wristworn device itself preferably comprises a wristworn device module; a first strap section having a first end and a second end, wherein the first end is coupled to a first end of the wristworn device module; a second strap section having a first end and a second end, wherein the first end is coupled to a second end of the wristworn device module, and wherein the second strap section further comprises a channel therein; a releasable coupling mechanism for releasably coupling the first strap section and the second strap section; wherein the second end of the first strap section is coupled to a first end of the releasable coupling mechanism and the second end of the second strap section is coupled to a second end of the releasable coupling mechanism; wherein the releasable coupling mechanism comprises an inserting section comprising a locking member, and a receiving section comprising a slidable locking plate that releasably engages the locking member to releasably couple the inserting section of the releasable coupling mechanism and the receiving section of the releasable coupling mechanism; an elongated member having a portion thereof positioned within the channel of the second strap section, wherein the elongated member comprises (i) a first end coupled to the slideable locking plate and (ii) an actuation section that extends from the channel of the second strap section; and wherein the method comprises the steps of applying a directional force upon the actuation section of the elongated member to cause the slidable locking plate to move in a direction so as to disengage from the locking member; and separating the inserting section of the releasable coupling mechanism from the receiving section of the releasable coupling mechanism.

In a preferred embodiment, the wristworn device is in the form of a wristwatch.

BRIEF DESCRIPTION OF THE DRAWINGS

The above set forth and other features of the invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DETAILED DESCRIPTION OF THE PREFERRED EMBODIMENTS

Reference is first made very generally to FIGS. 1-5, which collectively show the general construction and usage of a preferred embodiment of the present invention in the form of a wristworn device, generally indicated at 10, with a releasable locking arrangement, constructed in accordance with a preferred embodiment of the present invention.

Figure 1:
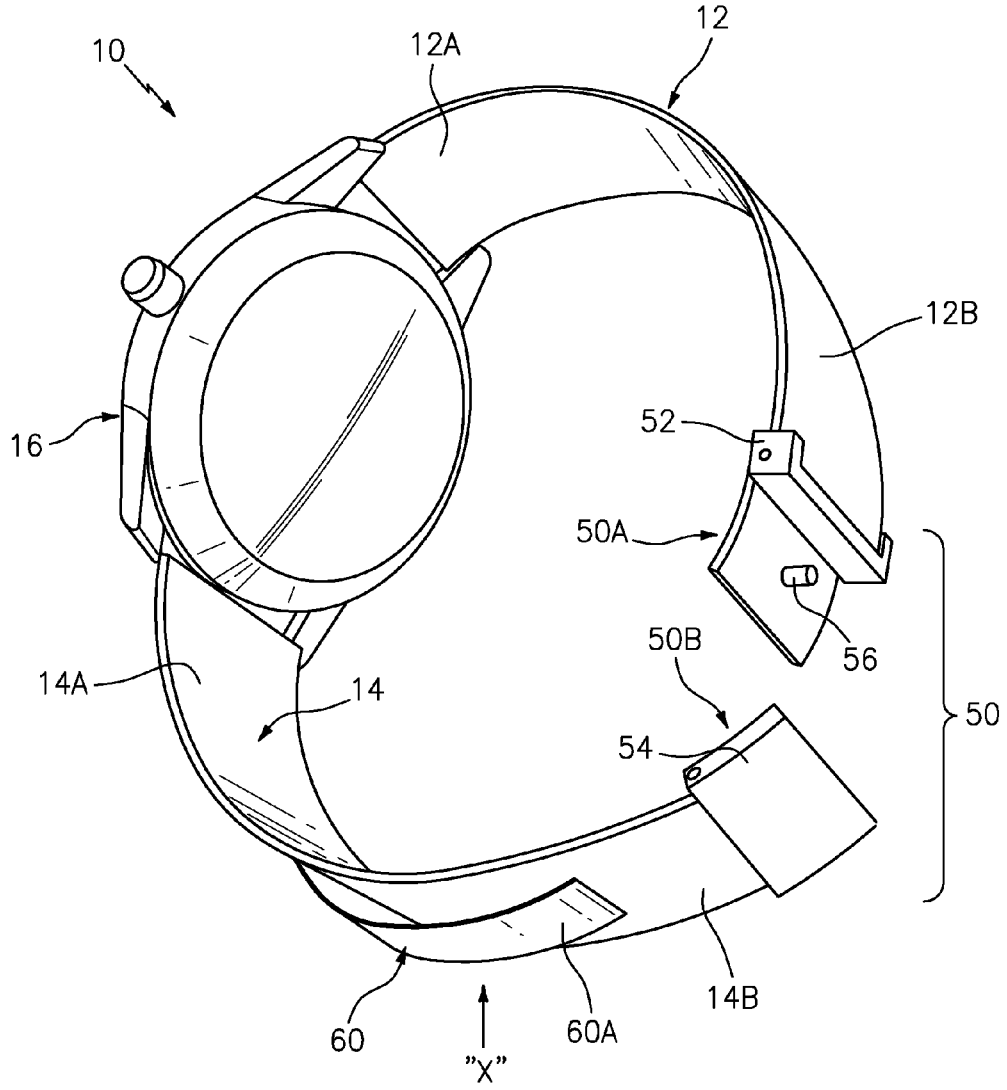
FIG. 1 is a perspective view of a wristworn device with a releasable locking arrangement constructed in accordance with a preferred embodiment of the present invention.

Generally speaking, FIG. 1 illustrates wristworn device 10 comprising a first strap section 12 having a first end 12A and a second end 12B, wherein the first end 12A is coupled to a first end of a wristworn device module, generally indicated at 16, and a second strap section 14 having a first end 14A and a second end 14B, wherein the first end 14A is coupled to a second end of the wristworn device module 16. Such coupling of the respective first ends 12A, 14A of the strap sections 12, 14 is preferably achieved using conventional lugs and springbars, as would be well understood in the art.

In accordance with preferred embodiments of the present invention, wristworn device 10 comprises a releasable coupling mechanism, generally indicated at 50, for coupling and decoupling (e.g. releasably coupling) the first strap section 12 and the second strap section 14. FIG. 1 further illustrates that the second end 12B of the first strap section 12 is coupled to a first end 52 of the releaseable coupling mechanism 50 and the second end 14B of the second strap section 14 is coupled to a second end 54 of the releaseable coupling mechanism 50. Further, and generally speaking, releasable coupling mechanism 50 comprises an inserting section, generally indicated at 50A, that comprises a locking member 56, and a receiving section, generally indicated at 50B, that comprises a slidable locking plate (not shown in FIG. 1) that engages with and disengages from locking member 56 to releasably couple the inserting section 50A of the coupling mechanism 50 with the receiving section 50B of the coupling mechanism 50. In accordance with preferred embodiments, the strap may be leather, plastic, or the like and the releasable coupling mechanism 50 may be metal or plastic. In a preferred embodiment, the strap and the releasable coupling mechanism 50 may be of different structural parts to maintain the aesthetic integrity of the present invention. In this way, the incorporation of the elongated member (discussed directly below) into the strap alone and/or in combination with the construction of the releasable coupling mechanism, yield patentably different constructions and methodologies.

FIG. 1 also generally illustrates an elongated member 60, preferably made of a spring-like material, having a portion thereof positioned within a channel of the second strap section 14, wherein the elongated member 60 comprises (i) a first end coupled to the slideable locking plate (as discussed below) and (ii) an actuation section 60A that extends outward from the channel of the second strap section, and which is easily accessible for applying a force thereto (e.g. actuation/depression), as will also be discussed further below.

That is, as will also be discussed in greater detail below, a directional force (e.g. in the direction of arrow "X" in FIGS. 1, 8B) upon the actuation section 60A of the elongated member 60 causes the slidable locking plate to move in a direction so as to disengage the locking member 56. In this way, separation of the inserting section 50A of the releasable coupling mechanism 50 from the receiving section 50B of the releasable coupling mechanism 50 is facilitated.

Figure 2:
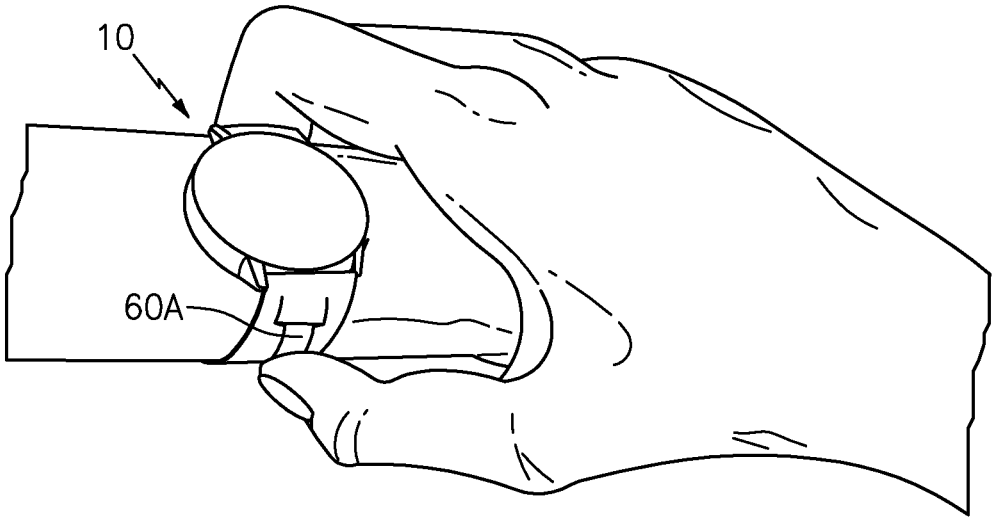
FIG. 2 illustrates the wristworn device of FIG. 1 mounted on a user's wrist, the figure also illustrating the initial steps in removing the wristworn device from the user's wrist in accordance with a preferred embodiment of the present invention.

FIG. 2 illustrates wristworn device 10 mounted on a user's wrist, and further illustrates the initial steps in removing the wristworn device 10 from the user's wrist, namely, by applying a force upon the actuation section 60A of elongated member 60, by as simple as a digit (e.g. thumb) of a user's one hand. Again, the operation of the present invention and the results thereof will be more particularly disclosed below.

Figure 3:
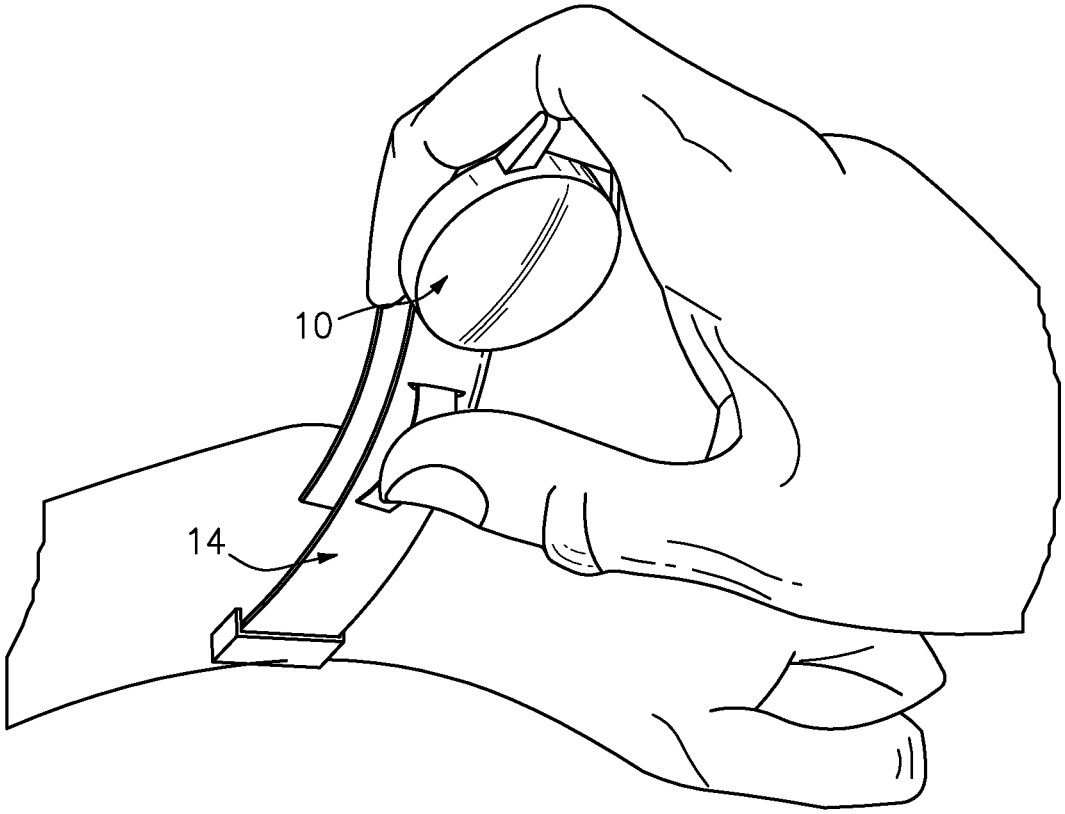
FIG. 3 illustrates a moment in time just after the wristworn device of FIG. 1 has been removed from the user's wrist in accordance with a preferred embodiment of the present invention.

However, in the interim, it should be noted that FIG. 3 illustrates just after the wristworn device 10 has been removed from the user's wrist in accordance with the present invention, namely that the inserting section 50A of the coupling mechanism 50 has been decoupled (e.g. disengaged) from the receiving section 50B of the coupling mechanism 50 by the actuation (e.g. pressing) of the actuation section 60A.

Figure 4:
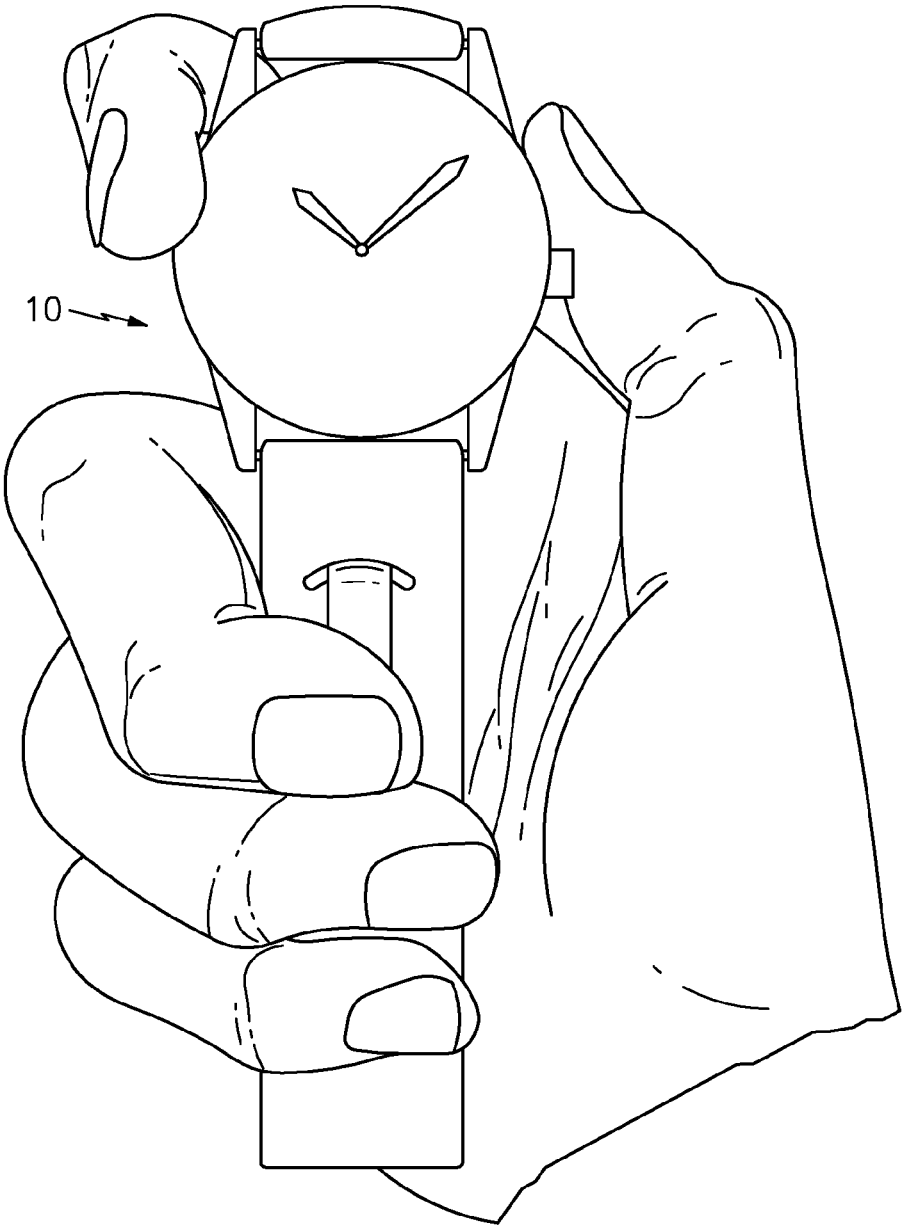
FIG. 4 illustrates an exemplary positioning of the wristworn device of FIG. 1 after removal from the user's wrist, e.g. illustrating how the wristworn device can easily be positioned against a user's ear or mouth, as desired.
Figure 5:
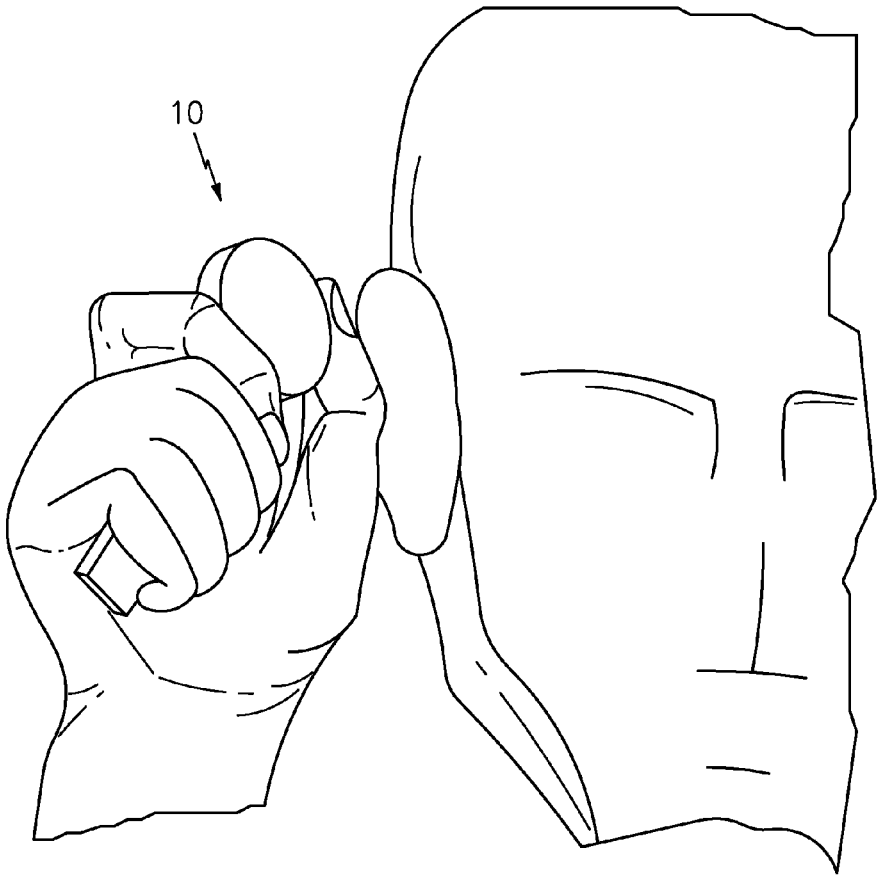
FIG. 5 illustrates an exemplary positioning of the wristworn device of FIG. 1 against the user's ear.

FIGS. 4 and 5 respectively illustrate an exemplary grasping of wristworn device 10 after removal from the user's wrist and an exemplary positioning of the wristworn device 10 against an ear of the user, which is most applicable and appropriate when wristworn device 10 includes functionality of music or a phone, e.g. including a speaker and/or a microphone so to hear and communicate with a person in a conventional way when communicating by phone. For the avoidance of doubt, the subject matter of U.S. Pat. Nos. 4,847,818; 5,218,577; 5,228,012; 5,235,560; 5,251,189 and 5,260,915 are all incorporated by reference as if fully set forth herein in their entireties for their disclosure of exemplary phone functionality in a wristworn device.

Reference is next made to FIGS. 6A, 6B, 6C, 6D which collectively may be referred to as "FIG. 6," and which illustrate a preferred embodiment of the present invention, namely, details of the releasable coupling mechanism 50, in a locked condition.

Generally speaking, receiving section 50B includes a cover member 68 and a plate member 70, where the plate member 70 includes an aperture through which locking member 56 can pass. Slidable locking plate 72 is positioned intermediate the cover member 68 and the plate member 70. As will be discussed in greater detail below, slidable locking plate 72 is movable laterally, e.g. namely in and out of locking engagement with locking member 56. Specifically, slidable locking plate 72 has a tab 72A that is engageable with a recess 56A in locking member 56.

Figure 6A:
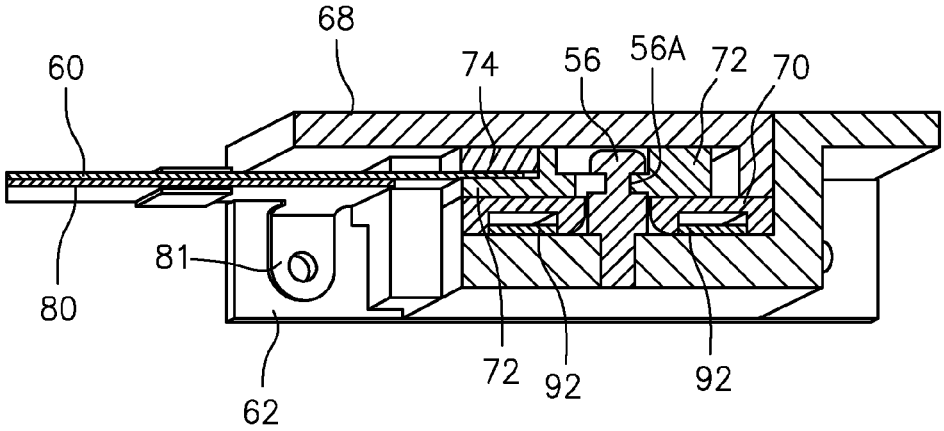
FIGS. 6A and 6B being perspective views and FIGS. 6C and 6D being cross-sectional views (with FIG. 6D merely being an enlargement of a section of FIG. 6C), collectively may be referred to as "FIG. 6," illustrate a preferred embodiment of the present invention, namely, details of the releasable coupling mechanism in a locked condition.
Figure 6B:
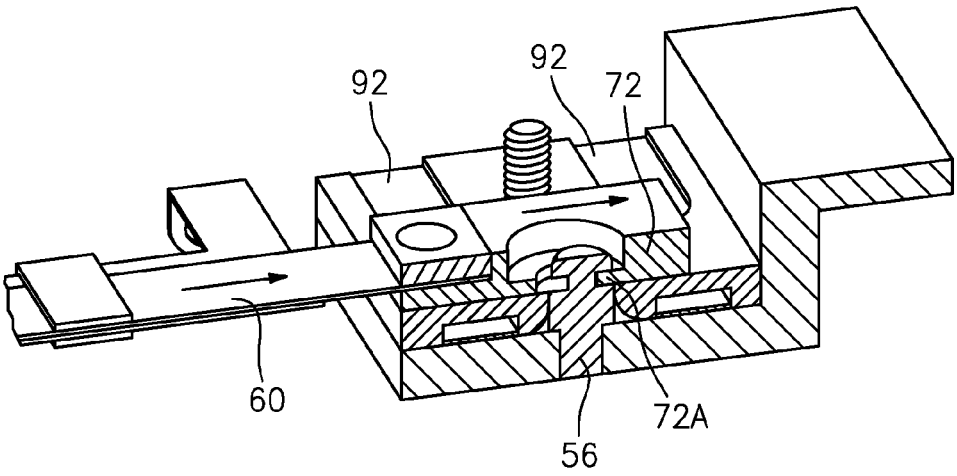
Figure 6C:
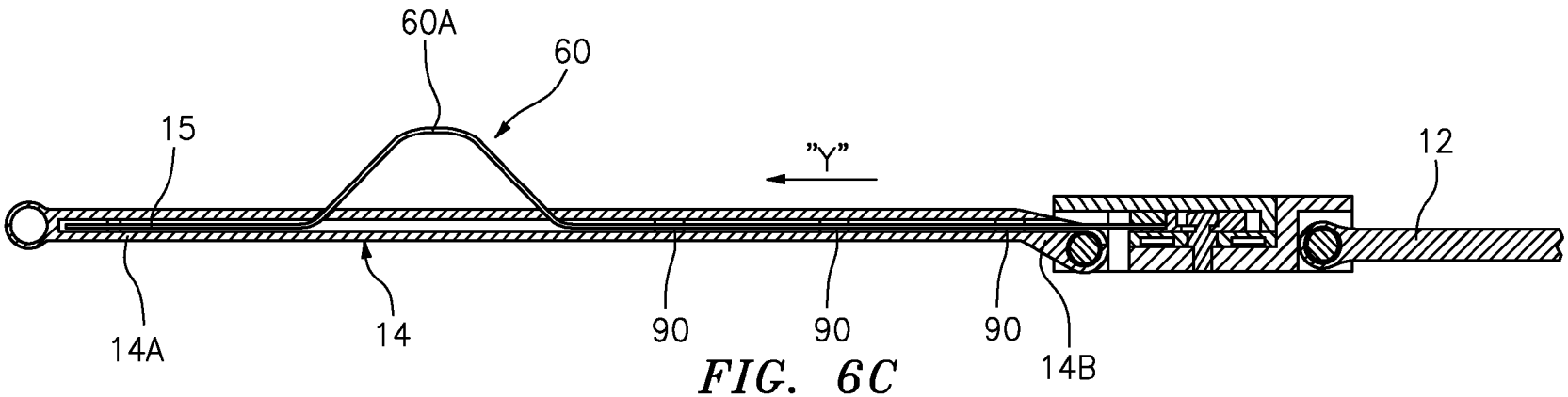
Figure 6D:
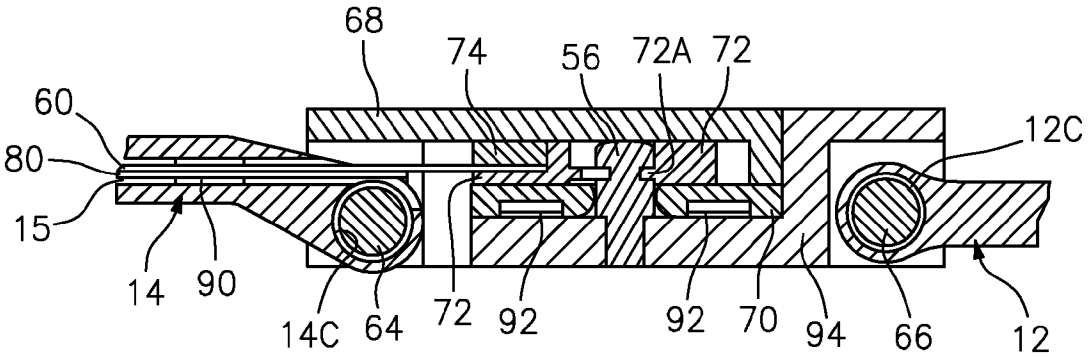
Figure 7A:
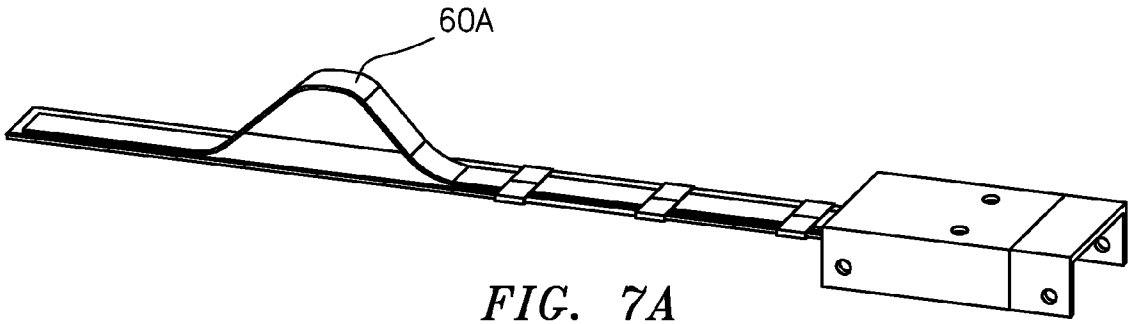
FIGS. 7A, 7B and 7C, which also may be collectively referred to as FIG. 7, highlight features of the elongated member that is constructed in accordance with a preferred embodiment of the present invention.
Figure 7B:
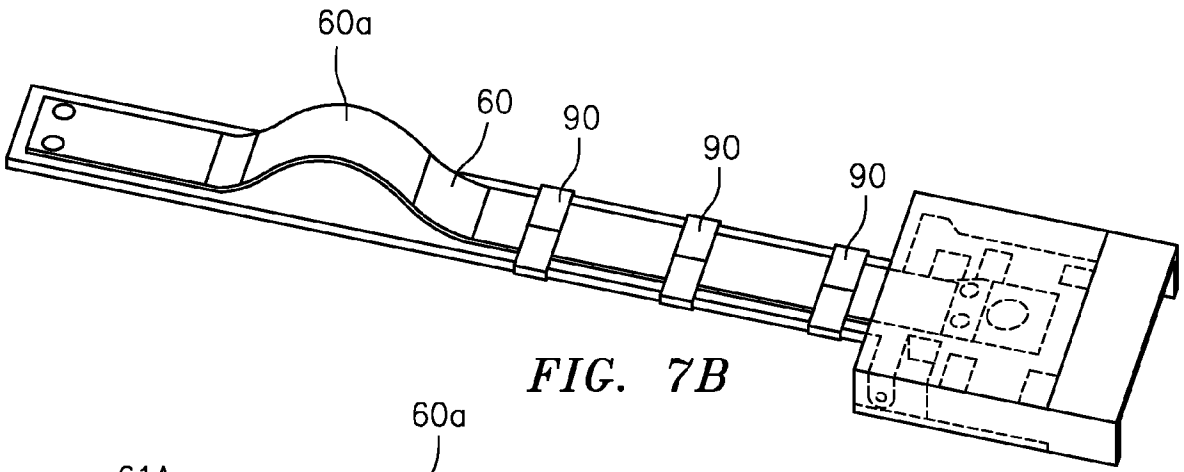
Figure 7C:
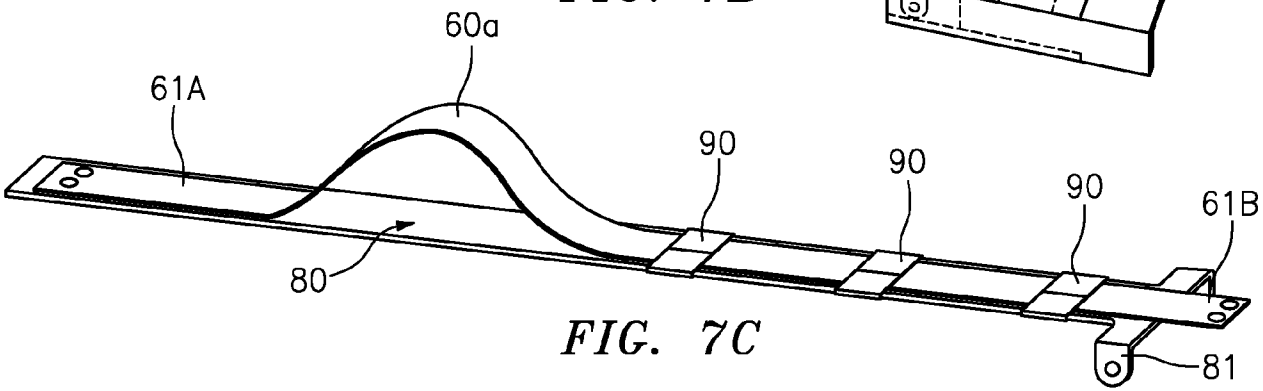

Along with specific reference to FIGS. 6C, 6D, reference is also made to FIGS. 7A, 7B and 7C (also collectively referred to as "FIG. 7"), which highlights features of the elongated member 60 as well as other proximate, associated and cooperating elements thereof.

For example, FIGS. 6C, 6D and those figures comprising FIG. 7 all illustrate that elongated member 60 is preferably of an elongated spring material with a formed bend (i.e. actuation section 60A) therein. Elongated member 60 is positioned within a channel 15 of strap section 14 and is secured at end 14A of strap section 14 by the use of rivets, welding or any other suitable means of securing within channel 15. At the other end thereof (i.e. proximate end 14B of strap section 14), elongated member 60 is preferably clamped to (and may further be riveted, welded, or the like) and/or otherwise secured between a slidable clamping plate 74 and slidable locking plate 72.

A guide band 80 may be provided and also extends within the channel 15 in the second strap section 14. Guide band 80 is also preferably of flexible material. At one end thereof (e.g. see FIG. 7C), guide band 80 may be secured to a distal end 61A of elongated member 60 with rivets, welds or the like, with said rivets, welds, or the like thereby also securing such ends of the guide band and the elongated member 60 to end 14A of strap section 14 as discussed above. At the other end, guide band 80 preferably has attached thereto a "U-shaped" member 81 that has openings at the ends thereof, and which itself is secured to an inner wall 62 of receiving section 50B (FIG. 6A) by the use of a bar 64, the bar 64 also preferably passing through a channel 14C in the second end 14B of strap section 14 (see FIGS. 6A, 6D). Although not described in exacting detail, but surely illustrated, for example in FIG. 6D, it is to be noted that the second end 12B of first strap section 12 may also be secured to inserting section 50A by use of a bar 66 that extends through a channel 12C in second end 12B. By securing guide band 80 at one end thereof with rivets, welds or the like, and at the other end with (e.g."U-shaped") member 81, guide band 80 is maintained in its position and is prevented from shifting within channel 15. Guide band 80 facilitates the lateral movement of the elongated member 60 within the channel 15 of the second strap section 14.

A plurality of guide elements 90 are also preferably used for securing the elongated member 60 to the guide band 80. These guide elements 90, among other things, assist in maintaining the integrity and shape of the actuation section 60A of member 60 along with facilitating its sliding therebetween and within the channel 15. That is, the guide elements 90 assist to maintain the desired "hump" in elongated member 60, but are not so tight as to hinder the ability of elongated member 60 from moving within the channel 15 as discussed herein.

FIGS. 6A, 6B, 6C and 6D illustrate that when there is no outside force upon the actuation section 60A of elongated member 60, elongated member 60 is naturally biased in the direction indicated by the arrow "Y" in FIG. 6C so as to maintain the tab 72A of slidable locking plate 72 within the recess 56A of locking member 56. In this way, it should be clear that FIGS. 6A, 6B, 6C and 6D illustrate releasable coupling mechanism in the "locked" position.

Figure 8A:
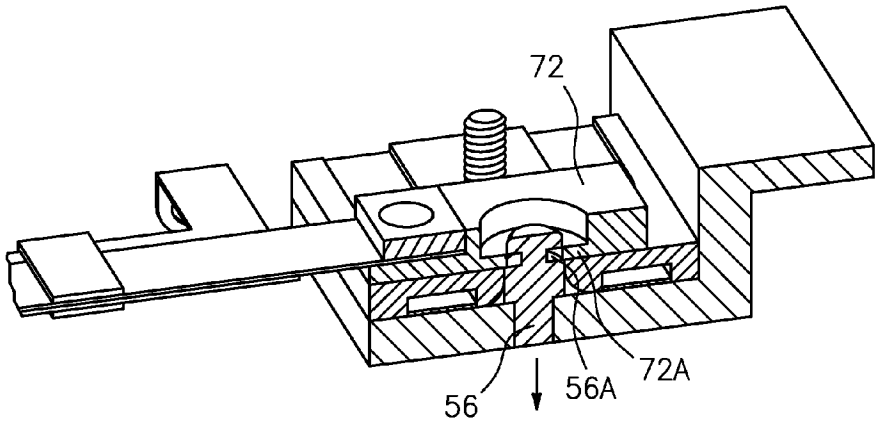
FIG. 8A being a perspective view and FIGS. 8B and 8C being cross-sectional views (with FIG. 8C merely being an enlargement of a section of FIG. 8B), collectively may be referred to as FIG. 8, illustrate the resulting actions when a downward (e.g. pressing) force is applied to the actuation section of the elongated member of the present invention thereby performing the unlocking of the releasable coupling mechanism of the present invention.
Figure 8B:
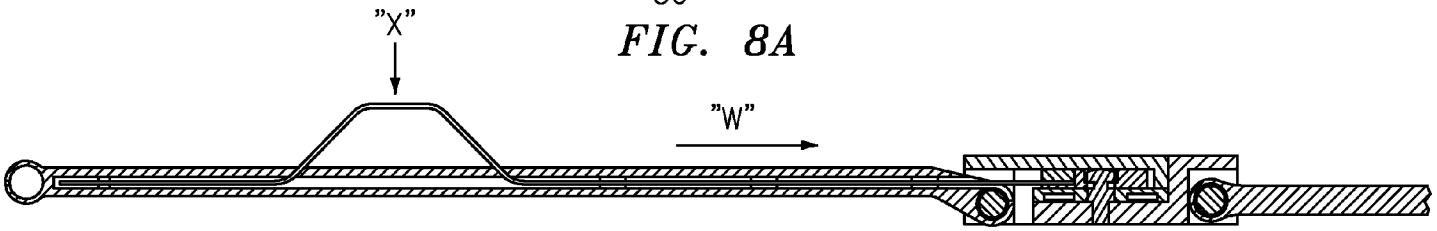
Figure 8C:
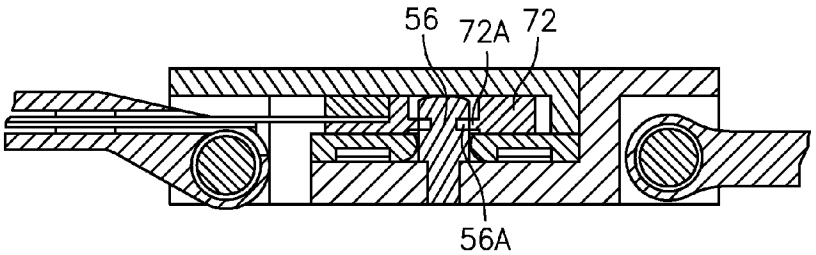

Reference is now made to FIGS. 8A, 8B and 8C, which also collectively may be referred to as "FIG. 8," which illustrate the resulting actions when a downward (e.g. pressing) force (e.g. as in the direction of arrow "X" in FIG. 8B) is applied to actuation section 60A (see also FIGS. 2, 3).

Specifically, because the end 61A of member 60 is locked in place with rivet(s), weld(s) or the like, the natural action is thus for end 61B (FIG. 7C) of elongated member 60 to slide axially in the direction of arrow "W" (see FIG. 8B). With end 61B of elongated member 60 clamped, riveted and/or otherwise secured between clamping plate 74 and slidable locking plate 72, slidable locking plate 72 can also move in the direction of arrow "W" until the tab 72A is moved out of the recess 56A of locking member 56 sufficiently to allow one or more biasing members 92, preferably in the form of springs, to urge the separation of inserting section 50A from receiving section 50B. When the action of depressing actuation section 60A is done in a fluid motion, the decoupling and separation of inserting section 50A from receiving section 50B occurs in a "snap-like action" because of the biasing of biasing members 92 upon a bottom plate 94 of inserting section 50A.

Figure 9A:
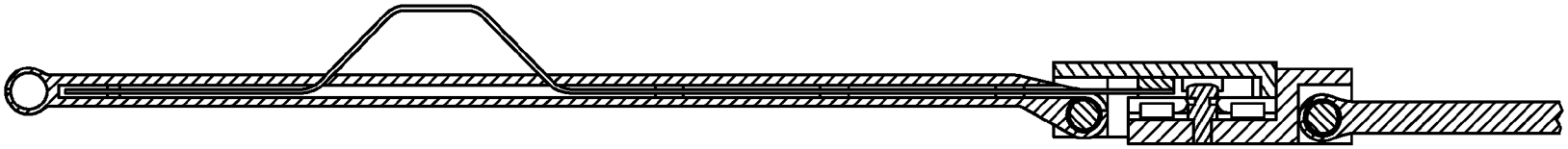
FIGS. 9A and 9B being cross-sectional views with FIG. 9B merely being an enlargement of a section of FIG. 9A, illustrate the positioning of certain elements of the receiving section at the beginning of the ejection of the locking member and separation from the inserting section.
Figure 9B:
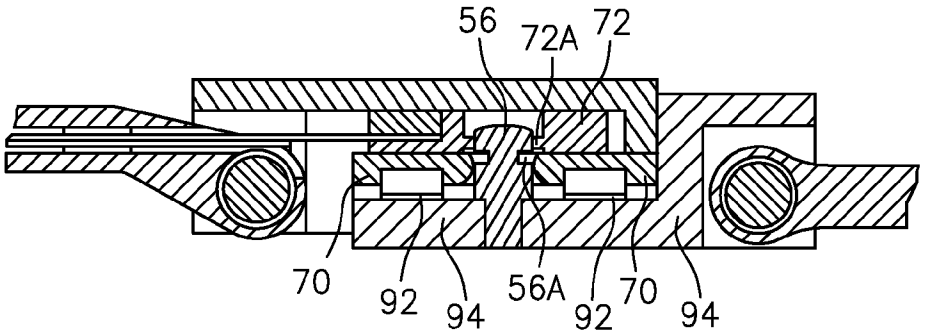

FIG. 9A, 9B provide a good illustration of the positioning of the elements of receiving section 50B at the beginning of ejection of locking member 56 and separation from inserting section 50A. That is, FIGS. 9A and 9B show slidable locking plate 72 out of engagement with the recess 56A of locking member 56 and also the beginning of the separation due to the spring action of biasing members 92, which are positioned between plate member 70 and bottom plate 94.

Figure 10A:
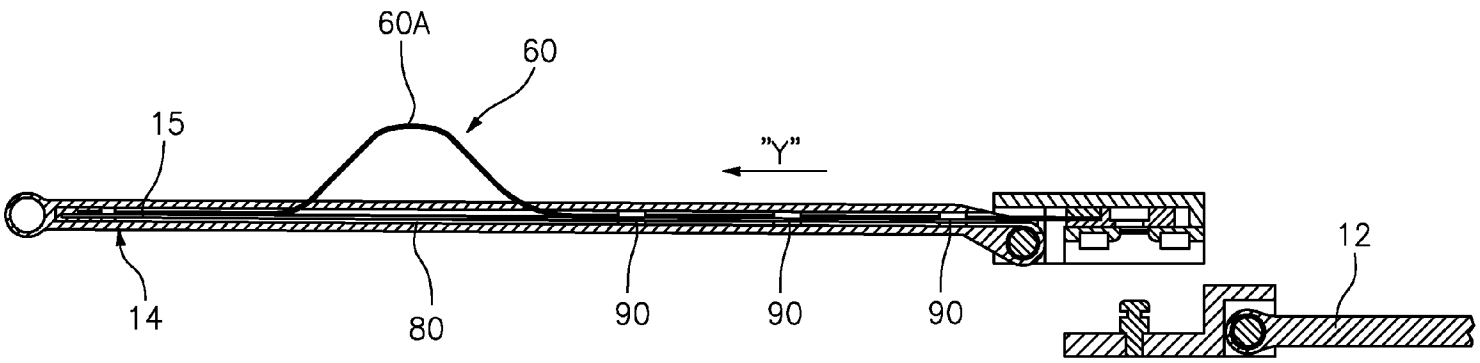
FIGS. 10A and 10B being cross-sectional views with FIG. 10B merely being an enlargement of a section of FIG. 10A, illustrate the separation of the inserting section and the receiving section of the releaseable coupling mechanism of a preferred embodiment of the present invention.
Figure 10B:
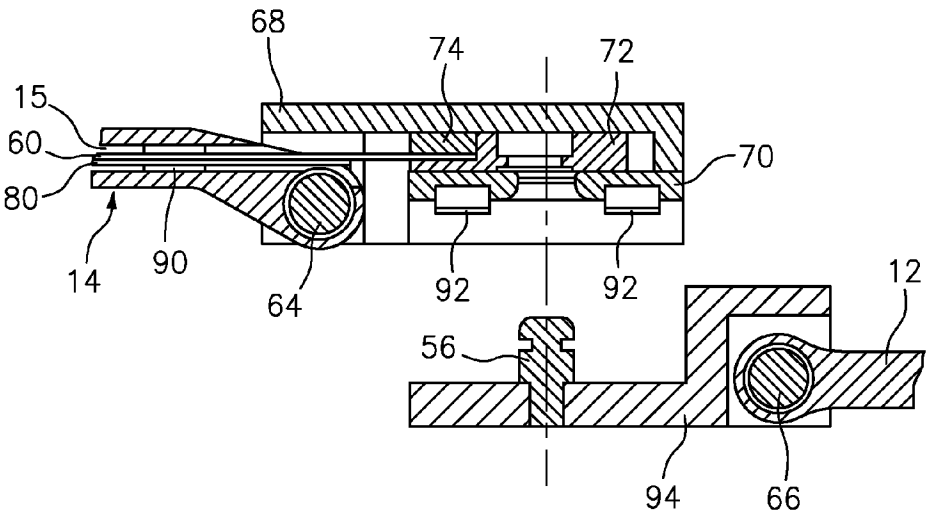

FIGS. 10A, 10B illustrate the separation of inserting section 50A and receiving section 50B. FIGS. 10A, 10B further illustrate that no actuation is being applied to actuation section 60A, and that (therefore), slidable locking plate 72 has once again been axially "pulled back" in the "Y" (see FIG. 6C) direction (i.e. the "hump" that comprises actuation section 60A has once again reformed to its original shape) due to the natural resiliency of section 60. It can also be seen that the opening in the slidable locking plate 72 is at least somewhat aligned with the opening in the plate member 70 so as to facilitate and accommodate the insertion of locking member 56, as will now be explained.

That is, to lock the inserting section 50A into the receiving section 50B and thereby couple the two together again, the locking member 56 merely needs to be aligned with the aforementioned opening in the plate member 70, so as to permit the locking member to be pushed through the openings of the plate member 70 and the slidable locking plate 72 until the tab 72A of the slidable locking plate reengages the recess 56A of the locking member 56. That is, locking member 56 is preferably provided with a rounded or chamfered top surface so as to allow the smooth displacement of the tab 72A as the top surface of the locking member 56 passes by. Since in the non-actuated (i.e. rest) position of the elongated member 60, the tab 72A is naturally biased towards recess 56A, once the recess 56A of locking member 56 passes tab 72A, the natural biasing thereof will allow for reengagement therebetween (i.e. as shown in FIG. 6). The pressing force of inserting section 50A relative to receiving section 50B need essentially only be sufficient to overcome the pushing force of the biasing members 92 as well as overcome the natural biasing force to push the tab 72A out of the way until its natural spring action allows it to reengage with the recess 56A. That is, the elongated member 60 will then again be in position to "pull" the slidable locking plate 72 into position in the recess 56A and the releasable coupling mechanism 50 will once again be locked.

As can be seen from the foregoing as well as the figures, the present invention provides for improvements over the prior art in that the present invention provides a wristworn device that facilitates the incorporation of phone and/or music (e.g. MP3) functionality, that facilitates and expedites the coupling and decoupling of the wristworn device to a wrist, that provides efficient and rapid removal of the wristworn device from the wrist for easy manipulation and placement proximate a person's ear, all the while achieving such objectives while still maintaining a high aesthetic quality of the wristworn device. Equally important is that the present invention provides an improved construction and method of being able to remove the wristworn device with only one hand. It is thus believed that all of the foregoing objectives set forth here will facilitate and promote increased usage and adoption of such a wristworn (phone and/or music) device.

Although the wristworn devices discussed and disclosed herein preferably have timekeeping functionality and may be in the form of a wristwatch, this is by example and not limitation. That is, the wristworn device for use with the present invention may be in the form of and/or have functionality related to blood pressure, heartrate, altitude, temperature or compass measurements, barometric pressure, (and/or combinations of any of the foregoing), just to name a few.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall therebetween.

What is claimed is:

1. A wristworn device comprising:

a wristworn device module;

a first strap section having a first end and a second end, wherein the first end is coupled to a first end of the wristworn device module;

a second strap section having a first end and a second end, wherein the first end is coupled to a second end of the wristworn device module, and wherein the second strap section further comprises a channel therein;

a releasable coupling mechanism for releasably coupling the first strap section and the second strap section;

wherein the second end of the first strap section is coupled to a first end of the releaseable coupling mechanism and the second end of the second strap section is coupled to a second end of the releaseable coupling mechanism;

wherein the releasable coupling mechanism comprises:

an inserting section comprising a locking member, and a receiving section comprising a slidable locking plate that releasably engages the locking member to releasably couple the inserting section of the releasable coupling mechanism and the receiving section of the releaseable coupling mechanism;

an elongated member having a portion thereof positioned within the channel of the second strap section, wherein the elongated member comprises (i) a first end coupled to the slideable locking plate and (ii) an actuation section that extends from the channel of the second strap section;

wherein a directional force upon the actuation section of the elongated member causes the slidable locking plate to move in a direction so as to disengage from the locking member;

whereby separation of the inserting section of the releasable coupling mechanism from the receiving section of the releasable coupling mechanism is facilitated upon the disengagement of the slidable locking plate from the locking member.

2. The wristworn device as claimed in claim 1, wherein the receiving section comprises a cover member and a plate member, and wherein the plate member includes an aperture through which the locking member can pass;

wherein the slidable locking plate is positioned intermediate the cover member and the plate member and the slidable locking plate is movable laterally in and out of locking engagement with the locking member.

3. The wristworn device as claimed in claim 2, wherein the slidable locking plate includes a tab that is engageable with a recess in the locking member.

4. The wristworn device as claimed in claim 1, wherein the elongated member is comprised of an elongated spring material, wherein the elongated member has a first end and a second end, wherein the first end of the elongated member is fastened to the second strap section and within the channel, and wherein the second end is coupled to the slidable locking plate.

5. The wristworn device as claimed in claim 4, wherein the slidable locking plate is movable laterally in and out of locking engagement with the locking member.

6. The wristworn device as claimed in claim 4, comprising a guide band that extends within the channel, wherein the guide band has a first end fastened in the channel proximate the first end of the elongated member and has a second end that is coupled to the receiving section;

wherein the guide band facilitates the lateral movement of the elongated member within the channel of the second strap section.

7. The wristworn device as claimed in claim 6, comprising at least one guide element for securing the elongated member to the guide band;

whereby the at least one guide element assists in maintaining the integrity and shape of the actuation section of the elongated member and assists in facilitating the sliding of the elongated member within the channel.

8. The wristworn device as claimed in claim 4, wherein the elongated member is configured so that in a non-actuated state, the elongated member is biased in a direction to maintain engagement of a tab of the slidable locking plate within a recess of locking member.

9. The wristworn device as claimed in claim 8, wherein an actuating force applied to the actuation section of the elongated member causes the second end of the elongated member to slide axially in the channel thus causing the slidable locking plate to also move axially in the same direction as the elongated member such that the tab of the slidable locking plate is moved out of the recess of the locking member.

10. The wristworn device as claimed in claim 9, comprising at least one biasing member, wherein the at least one biasing member urges a separation of the inserting section from the receiving section when the actuation force is applied to the actuation section and the tab of the slidable locking plate is moved out of the recess of the locking member.

11. A method of removing a wristworn device from a wrist of a user, wherein the wristworn device comprises a wristworn device module; a first strap section having a first end and a second end, wherein the first end is coupled to a first end of the wristworn device module; a second strap section having a first end and a second end, wherein the first end is coupled to a second end of the wristworn device module, and wherein the second strap section further comprises a channel therein; a releasable coupling mechanism for releasably coupling the first strap section and the second strap section; wherein the second end of the first strap section is coupled to a first end of the releaseable coupling mechanism and the second end of the second strap section is coupled to a second end of the releaseable coupling mechanism; wherein the releasable coupling mechanism comprises an inserting section comprising a locking member, and a receiving section comprising a slidable locking plate that releasably engages the locking member to releasably couple the inserting section of the releasable coupling mechanism and the receiving section of the releaseable coupling mechanism; an elongated member having a portion thereof positioned within the channel of the second strap section, wherein the elongated member comprises (i) a first end coupled to the slideable locking plate and (ii) an actuation section that extends from the channel of the second strap section; wherein the method comprises the steps of:

applying a directional force upon the actuation section of the elongated member to cause the slidable locking plate to move in a direction so as to disengage from the locking member; and separating the inserting section of the releasable coupling mechanism from the receiving section of the releasable coupling mechanism.

12. The method as claimed in claim 11, wherein the slidable locking plate includes a tab that is engageable with a recess in the locking member and wherein an actuating force applied to the actuation section of the elongated member causes an end of the elongated member to slide axially in the channel thus causing the slidable locking plate to also move axially in the same direction as the elongated member such that the tab of the slidable locking plate is moved out of the recess of the locking member, and further wherein the wristworn device comprises at least one biasing member, wherein the at least one biasing member urges a separation of the inserting section from the receiving section when the actuation force is applied to the actuation section and the tab of the slidable locking plate is moved out of the recess of the locking member, wherein the method comprises the step of:

causing the end of the elongated member to slide axially in the channel and causing the slidable locking plate to move axially in the same direction as the elongated member such that the tab of the slidable locking plate is moved out of the recess of the locking member, and urging the separation of the inserting section from the receiving section when the actuation force is applied to the actuation section and the tab of the slidable locking plate is moved out of the recess of the locking member by the at least one biasing member.

13. The method as claimed in claim 12, wherein the removal of the wristworn device from the wrist of user requires only one hand.

14. The method as claimed in claim 13, wherein the directional force upon the actuation section of the elongated member is applied by a thumb of the user.

* * * * *

UNITED STATES PATENT AND TRADEMARK OFFICE

CERTIFICATE OF CORRECTION

PATENT NO. : 9,125,460 B2
APPLICATION NO. : 13/964383
DATED : September 8, 2015
INVENTOR(S) : Olsen et al.

It is certified that error appears in the above-identified patent and that said Letters Patent is hereby corrected as shown below:

In the claims

Column 9

Line 5, claim 4, delete "fastened to the second strap section and within" and replace it with --fastened within--

Column 10

Line 27, claim 12, delete "causes an end" and replace it with --causes the first end--
Line 29, claim 12, delete "as the elongated member" and replace it with --as the first end of the elongated member--
Line 38, claim 12, delete "the end" and replace it with --the first end--
Line 40, claim 12, delete "as the elongated" and replace it with --as the first end of the elongated--

Signed and Sealed this
Nineteenth Day of April, 2016

Michelle K. Lee

Michelle K. Lee
*Director of the United States Patent and Trademark Office*